United States Patent [19]

Park

[11] Patent Number: 5,023,508

[45] Date of Patent: Jun. 11, 1991

[54] IN-LINE TYPE ELECTRON GUN FOR COLOR CATHODE RAY TUBE

[75] Inventor: In-gyu Park, Suwon, Rep. of Korea

[73] Assignee: Samsung Electron Devices Co., Ltd., Rep. of Korea

[21] Appl. No.: 446,819

[22] Filed: Dec. 6, 1989

[30] Foreign Application Priority Data

Dec. 15, 1988 [KR] Rep. of Korea ..... 88-20777

[51] Int. Cl.[5] ..... H01J 29/51

[52] U.S. Cl. ..... 313/414; 313/412; 313/413; 313/449

[58] Field of Search ..... 313/412, 413, 414, 449

[56] References Cited

U.S. PATENT DOCUMENTS 4,443,736 4/1984 Chen ..... 313/449
4,558,253 12/1985 Bechis et al. ..... 313/414
4,583,024 4/1986 Chen ..... 313/414
4,678,964 7/1987 Peels ..... 313/414
4,728,859 3/1988 Natsuhara et al. ..... 313/414

*Primary Examiner*—Sandra L. O'Shea
*Assistant Examiner*—N. D. Patel
*Attorney, Agent, or Firm*—Leydig, Voit & Mayer

[57] ABSTRACT

An in-line type electron gun for a cathode ray tube includes a cathode, a control grid, a screen grid, and a main lens including a final focus electrode and an anode forming a major lens, at least one of the focus electrode and anode including a first member with three independent beam passing holes disposed at a beam passing plane thereof and a second member with a common beam passing hole disposed at a beam passing plane thereof, the beam passing planes being separated from each other by a fixed distance. According to the present invention, electron beam control errors originating from manufacturing errors can be reduced to a great degree. The electron gun of the present invention is simple and convenient to manufacture with a low product defect rate.

2 Claims, 3 Drawing Sheets

IN-LINE TYPE ELECTRON GUN FOR COLOR CATHODE RAY TUBE

FIELD OF THE INVENTION

The present invention relates to an electron gun for color cathode ray tube and, particularly, to an improved electron gun for a color cathode ray tube in which the electrodes of the main lens are improved, and consequently, the beam characteristics are improved to produce good quality images.

BACKGROUND OF THE INVENTION

In an in-line type electron gun is constituted such that three electron beams advance along paths in substantially the same plane. The electrons are emitted from three cathodes and are focused by means of a plurality of electrodes, each having three beam passing holes, ultimately focusing the beams on a screen. A dynamic deflecting magnetic field is established between the electron gun and the screen for determining the landing positions of the beams. The magnetic field is formed by a deflecting yoke to which horizontal and vertical deflecting signals are supplied and which sequentially deflects the beams onto the whole surface of the screen.

When electron beams advance toward the screen after having departed from the electron gun, and are deflected by the deflecting magnetic fields, the electron beams are distorted by non-uniform vertical and horizontal magnetic fields. The distortions are particularly significant when the beams scan the peripheral portions of the screen. Due to such distortions of the electron beams, laterally elongated beam spots may be formed on the screen.

The deflection aberrations are improved by the electron gun which is disclosed in U.S. Pat. No. 4,558,253, and which, as illustrated in FIG. 1, includes a cathode K, a control grid G1, a screen grid G2, and electrodes G3,G4,G5,G6. Particularly, the beam passing planes of the electrodes G5r, G6, which constitute a major lens, are respectively provided with recesses 5R,6R at the centers thereof and three beam passing holes 5H,6H have projecting peripheral rims 5B,6B.

Accordingly, a complex electric field is formed between the electrodes G5r, and G6, and consequently, three major lenses having large diameters and reduced spherical aberrations are formed. The peripheral major lenses are formed in an asymmetrical manner, thereby reducing the deflection aberrations of the peripheral electron beams.

However, in the major lens formed by the electrodes G5r, G6, a focusing difference occurs between the vertical and horizontal directions with the result that the focus quality characteristics are reduced increasing the likelihood of spherical aberrations.

Further, the electrodes G5r, G6 are complicated in their structures, and, therefore, the manufacturing process is difficult. Particularly, the portions requiring a high processing precision, i.e., the beam passing holes and the rims around them undergo plastic deformations during forming in a press with the result that high stresses are concentrated on the portions where the deformations have occurred, thereby reducing precision. Further, depending on the circumstances, partial disruptions can occur, thereby bringing a failure to the manufacturing of the electrodes.

SUMMARY OF THE INVENTION

Therefore, it is the object of the present invention to provide an in-line type electron gun for a color cathode ray tube in which the structure is improved such that the manufacturing is convenient and the focusing characteristics are improved, thereby upgrading the resolution of the screen.

In achieving the above object, the in-line type electron gun for a cathode ray tube according to the present invention comprises a triode comprising a cathode, a control grid and a screen grid, and a main lens means including a final focus electrode and an anode, at least one of which includes:

a first member having three independent beam passing holes disposed in the beam passing plane of the first member; and a second member having a common beam passing hole disposed in the beam passing plane of the second member, said second member being separated by a fixed distance from the beam passing plane of said first member.

The electrode is very convenient to manufacture. Particularly, because the beam passing holes are formed in vertically elongate and laterally elongate shapes, the electron beams passing through these holes become vertically elongate to form normally circular beam spots upon arrival at the screen, thereby improving the resolution of the screen to a great degree.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
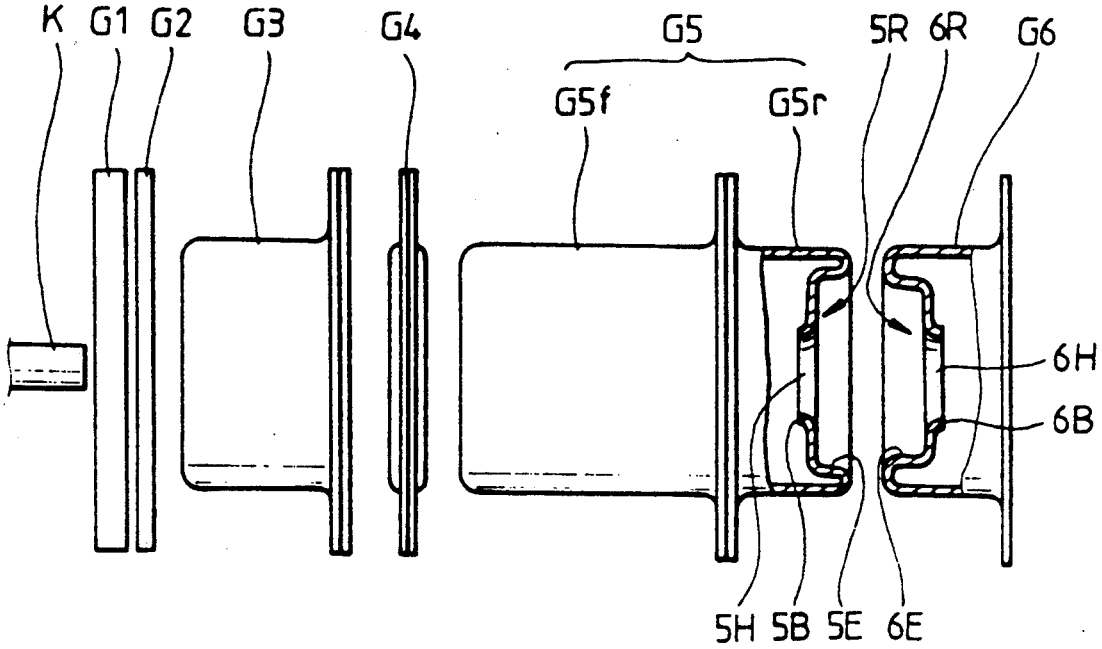
FIG.1(Prior Art)
FIG. 1 is a schematic partly sectional view of the conventional in-line type electron gun having a major lens for producing asymmetrical electric fields.
Figure 2:
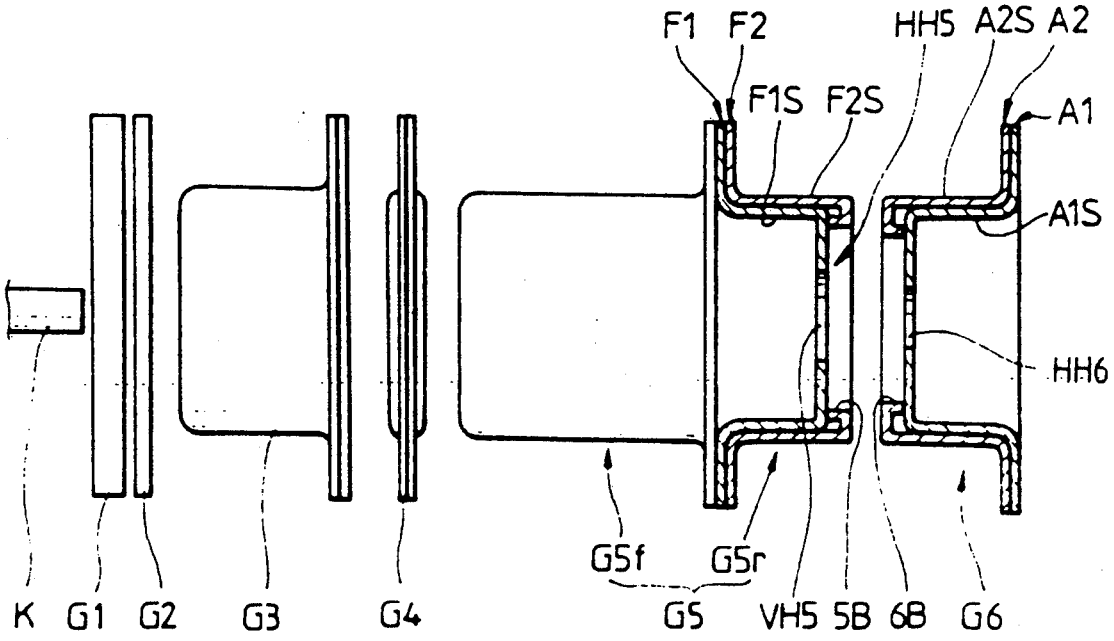
FIG. 2 is a schematic partly sectional view of a preferred embodiment of an electron gun according to the present invention.

FIG. 2 illustrates an electron gun provided with electrodes according to the present invention. As in the case of the usual electron gun, this electron gun includes a cathode K, control grid G1, a screen grid G2, and a plurality of electrodes G3,G4,G5,G6. The electrode G5 is a focusing electrode assembly to which a high potential focus voltage is applied. This electrode assembly includes a prefocus electrode G5f forming a prefocus lens in cooperation with the electrode G4 and a major focus electrode G5r forming a major focus lens in cooperation with the electrode G6.

Figure 3B:
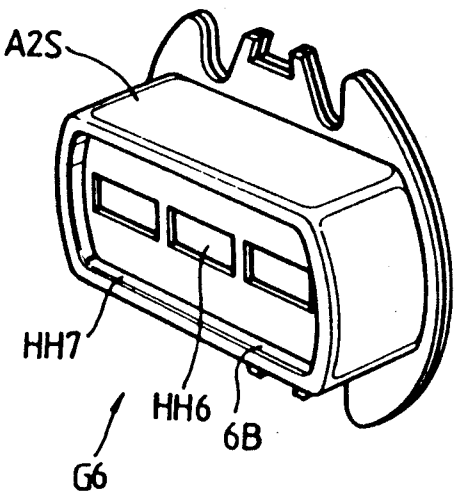
FIG. 3B is a perspective view of an anode for forming the major lens in the electron gun as shown in FIG. 2.
Figure 3A:
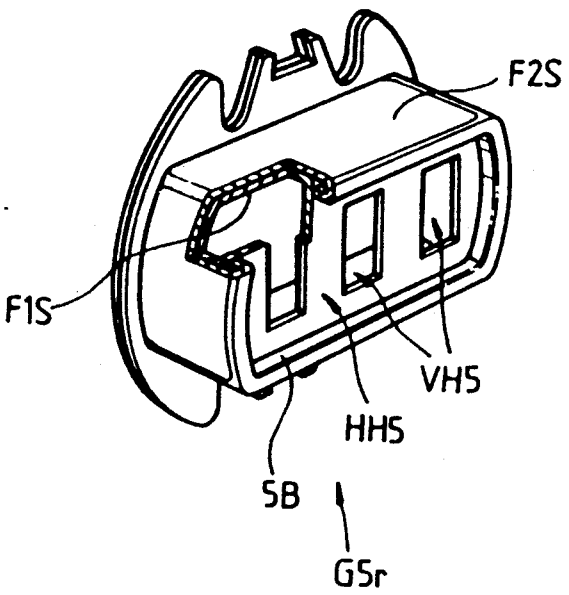
FIG. 3A is a perspective view of a focus electrode for forming the major lens in the electron gun shown in FIG. 2.

As shown in FIG. 3A, the major focus electrode (to be called hereinafter focus electrode G5r) includes a cup shaped first member F1 having three vertically elongate rectangular beam passing holes VH5 therein and provided with skirt F1S and a cup shaped second member F2 with a single laterally elongate beam passing hole HH5 formed therein and provided with a skirt F2S. The edge of the second member around the beam passing hole HH5 is provided with a rim 5B with the end of the rim contacting the first member at its beam passing plane. Meanwhile, the skirt F1S of the first member F1 and the skirt F2S of the second member F2 closely contact each other.

The electrode G6 on which the highest anode voltage is applied includes a first member A1 and a second member A2 which are cup-shaped and similar in their shapes to the first and second members F1,F2 of said electrode G5r. Here, the skirt of A1S of the first member F1 and the skirt A2S of the second member A2 also closely contact each other. The beam passing plane of the first member A1 is provided with three laterally elongate beam passing holes HH6 which form asymmetrical quadrupole lenses in cooperation with the three vertically elongate rectangular beam passing holes VH5. The second member A2 is provided with a rim 6B along the circumference of the beam passing holes HH7 contacting the first member A1 at its beam passing plane.

The electron gun of the present invention as described above corrects for the deflection aberrations which originate from the large diameter asymmetrical lens formed between the electrodes G5r and G6. Further, improved focus characteristics can be expected from the asymmetrical quadrupole lenses which are formed between the beam passing holes VH5,HH6 of the first members of the electrodes G5r and G6.

Figure 4A:
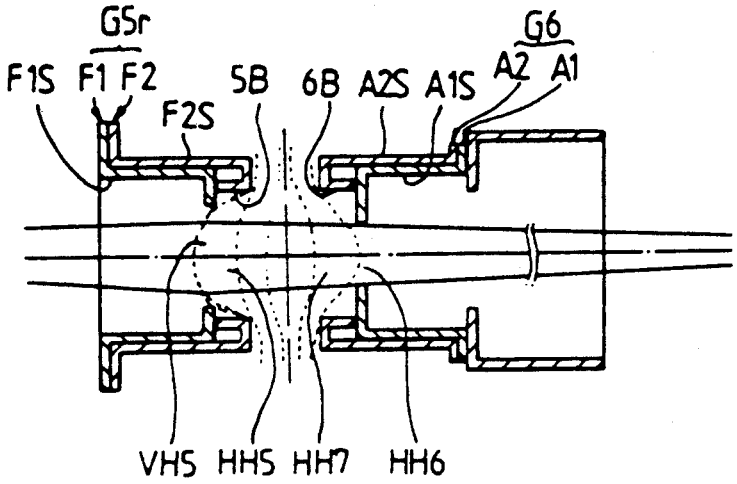
FIG. 4A illustrates the control of the electron beams in the vertical direction in the electron gun of the present invention.

The control of the electron beams realized through the electrodes G5r,G6 in the vertical direction is as shown in FIG. 4A. When the electron beams pass through the first member F1 of the electrode G5r, the electron beams receive weak focusing forces in the vertical direction, while, when they pass through the first member A1 of the electrode G6, they receive strong diverging forces in the vertical direction.

Figure 4B:
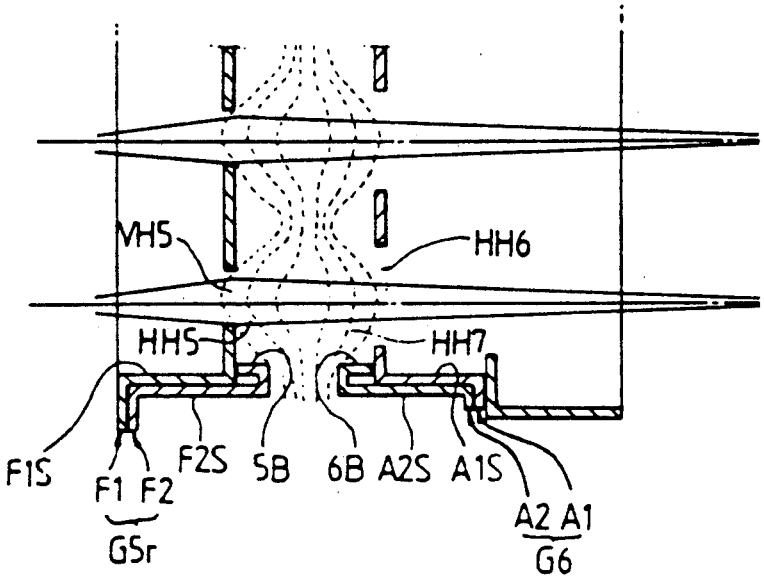
FIG. 4B illustrates the control of the electron beams in the horizontal direction in the electron gun of the present invention.

The control of the electron beams in the horizontal direction is as shown in FIG. 4B. When the electron beams pass through the first member F1 of the electrode G5r, they receive strong focusing forces in the horizontal direction, while, when they pass through the first member A1 of the electrode G6, they receive weak diverging forces in the horizontal direction.

Thus, the electron beams are controlled in different ways in the vertical and horizontal directions so that the electron beams are vertically elongated during passing through the major lens so that they form substantially normal circular beam spots upon landing on the screen owing to the influence of the deflection aberrations caused by the deflecting magnetic fields.

As described above, the electron gun according to the present invention is provided with major lens-forming electrodes which are divided respectively into the first and second members which are simple and convenient to manufacture, and, therefore, the control errors for the electron beams originating from the manufacturing (processing) errors can be reduced to a great degree.

The first members F1,A1 and the second members F2,A2 of the respective electrodes are shaped like a cup, and the skirts of them closely contact each other with the result that the relative positional errors between the beam passing holes VH5,HH6 of the first members F1,A1 and the beam passing holes HH5,HH7 of the second members F2,A2 are minimized. Further, the gaps between the pairs of the beam passing holes are controlled by the extensions of the rims 5B,6B, and, therefore, the separation between the beam passing holes can be adjusted.

The electron gun of the present invention as described above is easy to manufacture and easily precisely assembled. In addition, it improves the focus characteristics of the electron beams through the major lens, including a large diameter lens and a quadrupole lens. Therefore, the product defect rate is lowered, and the quality of the cathode ray tube is improved.

What is claimed is:

1. An in-line type electron gun for a cathode ray tube comprising:

a triode including a cathode, a control grid, and a screen grid; and a main lens including a final focus electrode and an anode forming a major lens of said main lens, at least one of said final focus electrode and anode including:

a cup-shaped first member having a first tubular skirt and a first bottom plate depending from said first tubular skirt including three independent beam passing holes disposed at a beam passing plane of said first member; and a second member having a second tubular skirt and a second bottom plate depending from said second tubular skirt and including a common beam passing hole disposed at a beam passing plane of said second member and a peripheral rim projecting into said second tubular skirt at the periphery of the common beam passing hole, said first tubular skirt being disposed tightly fitting within and contacting said second tubular skirt with said first bottom plate abutting and contacting said rim.

2. The in-line type electron gun for a cathode ray tube as claimed in claim 1 wherein said rim contacting said first member establishes a distance separating the beam passing planes of said first and second members.

* * * * *